US005194843A

United States Patent [19]

Jones et al.

[11] Patent Number: 5,194,843

[45] Date of Patent: Mar. 16, 1993

[54] AUTOMATIC VEHICULAR TIMING AND SCORING SYSTEM

[75] Inventors: R. David Jones, Fort Worth; Arthur F. Sweeney, Dallas, both of Tex.

[73] Assignee: Progressive Concepts, Inc., Fort Worth, Tex.

[21] Appl. No.: 719,850

[22] Filed: Jun. 24, 1991

[51] Int. Cl.[5] ..... G08B 23/00; A63F 9/14

[52] U.S. Cl. ..... 340/323 R; 340/539; 455/67.3; 364/410; 273/86 R

[58] Field of Search ..... 340/323 R, 539; 455/41, 455/9, 19, 22, 67, 185, 260, 267, 67.1, 67.3, 185.1; 364/410, 411, 227.1; 273/86 R

[56] References Cited

U.S. PATENT DOCUMENTS

| | | | |
|---|---|---|---|
| 3,546,696 | 12/1970 | Waters . | |
| 3,588,869 | 6/1971 | Clift | 340/323 |
| 3,714,649 | 1/1973 | Brouwer et al. . | |
| 3,795,907 | 3/1974 | Edwards | 340/323 R |
| 4,142,680 | 3/1979 | Oswald et al. | 235/92 |
| 4,274,076 | 6/1981 | Hermanns et al. . | |
| 4,315,242 | 2/1982 | Lueg et al. . | |
| 4,449,114 | 5/1984 | Fascenda et al. | 340/988 |
| 4,551,725 | 11/1985 | Schaffer . | |

*Primary Examiner*—Donnie L. Crosland
*Attorney, Agent, or Firm*—Geoffrey A. Mantooth

[57] ABSTRACT

An automatic timing and scoring system equips vehicles with transmitters and places the receiving antenna on the track used by the vehicles. Each vehicle transmitter has a unique frequency. The receiving antenna is located so that the transmitters pass adjacent thereto. The receiving antenna is coupled to a receiver. The receiver has an amplifier and bandpass filters. The bandpass filters pass all of the transmitter frequencies, while rejecting much of the noise. The signal that is received by the receiving antennas is amplified and then limited to a predetermined amplitude. Then, the received signal is shifted in frequency to an intermediate frequency. The intermediate frequency signal is passed through a narrow bandpass filter that rejects all transmitter frequencies but the transmitter frequency of interest. Then, the intermediate frequency signal goes to a tone decoder, which detects signals having predetermined minimum durations. The detected signal is then sent to a computer that records the presence of the signal and the time of occurrence of the signal. The computer tracks the laps of each vehicle as well as elapsed time of each vehicle.

13 Claims, 3 Drawing Sheets

AUTOMATIC VEHICULAR TIMING AND SCORING SYSTEM

FIELD OF THE INVENTION

The present invention relates to systems for tracking the progress of vehicles on a course. Such systems are used for instance, in timing and scoring race cars as they are driven around a race track.

BACKGROUND OF THE INVENTION

Timing and scoring in car races is generally performed by human trackers. The trackers visually track each car as it is driven around the race track and record its lap number and elapsed time. Because races may have thirty or forty cars or more, and because it is difficult to continuously assimilate and tally the information from the human trackers, confusion as to timing and scoring can arise during a race. Occasionally, an error is made as to whether a car completed all of the laps or as to the relative position of each car. Such errors can be costly and embarrassing.

There have been attempts to automate the timing and scoring of a race. These automated prior art systems generally perform unsatisfactorily. For a timing and scoring system to perform satisfactorily, some technical problems must be overcome. First, the automated system must be able to resolve the position of each car at the finish line within a short distance. Such high spatial resolution is required in order to determine which car crossed the finish line first on each lap and in particular on the final lap. If the spatial resolution is too low, a car in second place that is only a short distance behind the first place car may be improperly identified as being tied for first place.

Another problem is that the automated timing and scoring system must be able to distinguish each car from the other cars. This of course is to allow tracking of each individual car. Furthermore, the system must be able to detect all of the cars simultaneously if need be. This is so if several cars cross the finish line simultaneously on a lap, all will be detected and none will be missed.

Still another problem involves the ambient electromagnetic noise found at race tracks. Race tracks are very noisy (in the electromagnetic sense) places. In addition to all of the local radio, television, powerline, etc. noise in the area, the ignition systems in the race cars produce high energy broad band noise. There are also two-way radios in use for communications between the drivers and their pit crews. Thus, an automated timing and scoring system must be able to identify real timing and scoring signals from noise signals. Inaccuracies are introduced whenever the system interprets a noise signal as a valid signal.

SUMMARY OF THE INVENTION

It is an object of the present invention to provide an automatic vehicular timing and scoring system.

It is a further object of the present invention to provide an automatic vehicular timing and scoring system that overcomes the problems described hereinabove.

The system of the present invention includes plural transmitter means, a receiving antenna and receiver means. There is a transmitter means located on each vehicle. Each transmitter means transmits a continuous wave signal that has a frequency that is unique with respect to the signals transmitted by the other transmitter means. The receiving antenna is located on the track such that the vehicles and the plural transmitter means can pass adjacent thereto. The receiving antenna produces a received signal for each transmitter means signal received by the receiving antenna. The receiver means is coupled to the receiving antenna. The receiver means includes narrow bandpass filter means, there being a narrow bandpass filter means on each one of a plural number of channels in the receiver means. Each channel is for detecting a received signal from one of the transmitter means. The narrow bandpass filter means on each channel is for filtering out all frequencies lying outside of the frequency of the respective received signal for that channel. Each channel has a mixer means therein. Each of the mixer means produces an intermediate frequency signal from the respective received signal. Each of the mixer means has a first input that is connected with a respective local oscillator and a second input that is connected with the receiving antenna. Each of the local oscillators produces signals such that the intermediate frequency signals on all of the channels have the same frequency. The output of the mixer means is connected with the respective narrow bandpass filter means. Each channel has a tone decoder means connected to an output of the respective narrow bandpass filter means. Each of the tone decoder means detects an intermediate frequency signal of a predetermined duration and produces an output signal whenever an intermediate frequency signal having the predetermined duration is detected, wherein the output signal indicates that the vehicle having the transmitter means with the frequency that has been assigned to the channel has passed adjacent to the receiving antenna.

In one aspect, each of the transmitter means operates in the 1-10 MHz range. In another aspect, the receiver means comprises a common mode differential amplifier that is connected with the receiving antenna. In still another aspect, the system further includes computer means for tabulating the output signals from the channels. The computer means are connected with an output of the plural tone decoder means. The computer means is also for tracking the elapsed time between output signals on each channel.

In still another aspect, each of the narrow bandpass filter means includes a crystal filter having a bandpass of 1.5-2 KHz. In still another aspect, each of the transmitter means includes a transmitting antenna that is configured to produce primarily a magnetic field.

The method of the present invention includes the steps of providing a transmitter means on each vehicle and a receiving antenna on the track. Each transmitter means transmits a signal. Each transmitted signal has a unique frequency with respect to the other transmitted signals. The vehicles are driven around the track so as to pass adjacent to the receiving antenna, wherein a received signal is produced in the receiving antenna by each of the transmitter means passing adjacent to the receiving antenna. Each of the received signals is filtered so as to remove those frequencies that are different from the respective received signal. Each of the received signals is filtered so as to remove noise signals having the same frequency as the respective received signal by rejecting those signals having a temporal duration that is less than a predetermined minimum duration and passing those signals having a temporal duration that is more than said predetermined duration. The occurrence of the respective passed signals is recorded so as to track the lap number of the respective vehicles. The time of occurrence of the respective passed signals is also recorded so as to track the elapsed time of the respective vehicles.

DESCRIPTION OF PREFERRED EMBODIMENT

Figure 1:
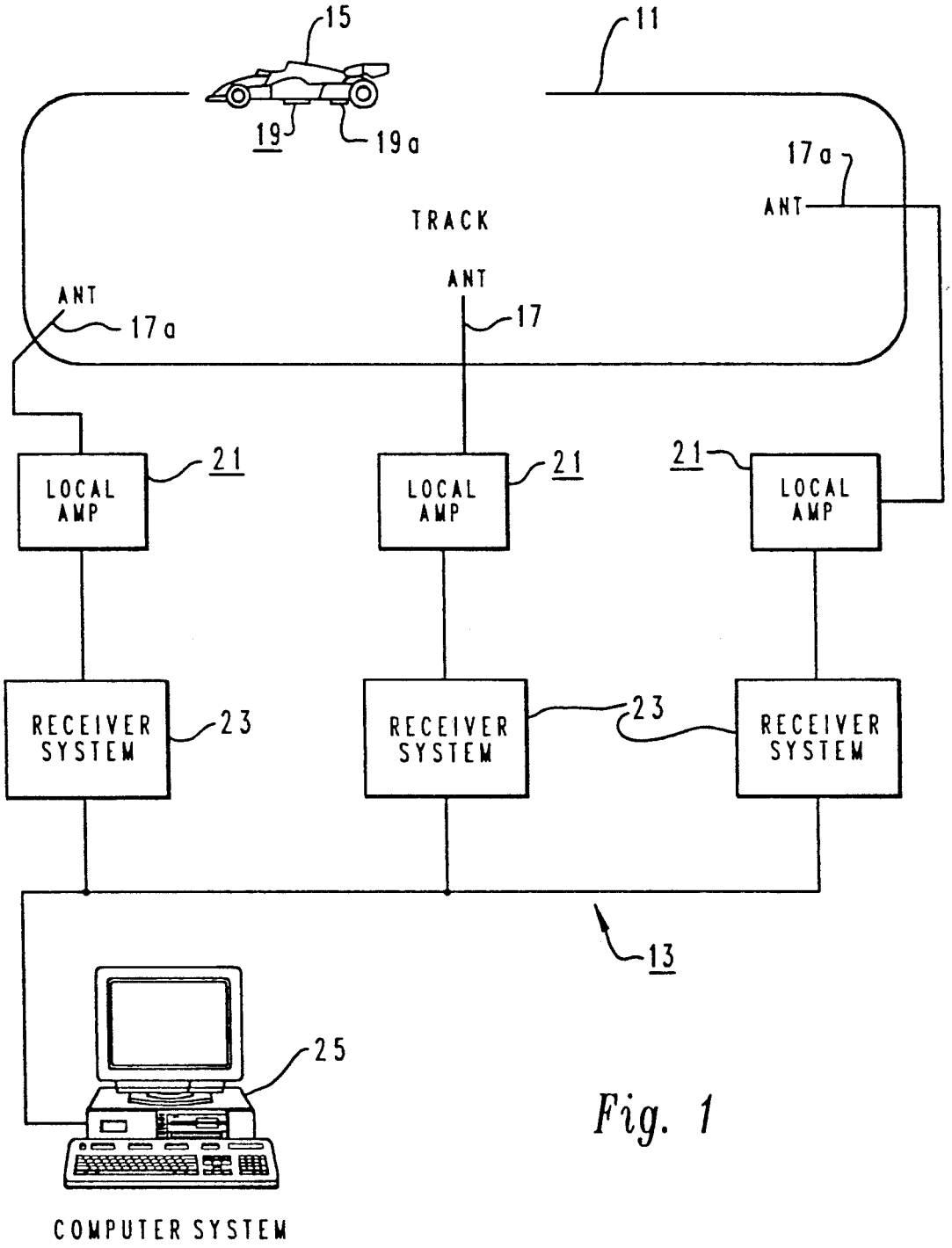
FIG. 1 is a schematic view of a race car track showing the timing and scoring system of the present invention, in accordance with a preferred embodiment, installed therein.

In FIG. 1, there is shown a schematic diagram of a track 11 that has the automated timing and scoring system 13 of the present invention, in accordance with a preferred embodiment, installed therein. Cars 15 are driven around the track 11 for racing or testing purposes. For example, the track can be used for racing cars of various types such as stock cars or Formula 1 cars. The track can also be used as a course on which to evaluate and test various types of vehicles.

The timing and scoring system 13 of the present invention automatically counts the number of laps each car 15 has made around the track 11 and automatically times the elapsed time of each car. The main sensor 17 is located at the finish line so that as each car crosses the finish line on each lap, it is tracked and timed. In addition, other sensors 17A can be positioned at various locations along the track to provide further information. For example, sensors can be placed at the beginning and end of curves to provide information that is used in determining a car's acceleration through the curve.

The timing and scoring system 13 includes a transmitter 19, one or more receiving antennas 17, 17A, one or more local amplifiers 21, one or more receiver systems 23 and a computer system 25.

Figure 2:
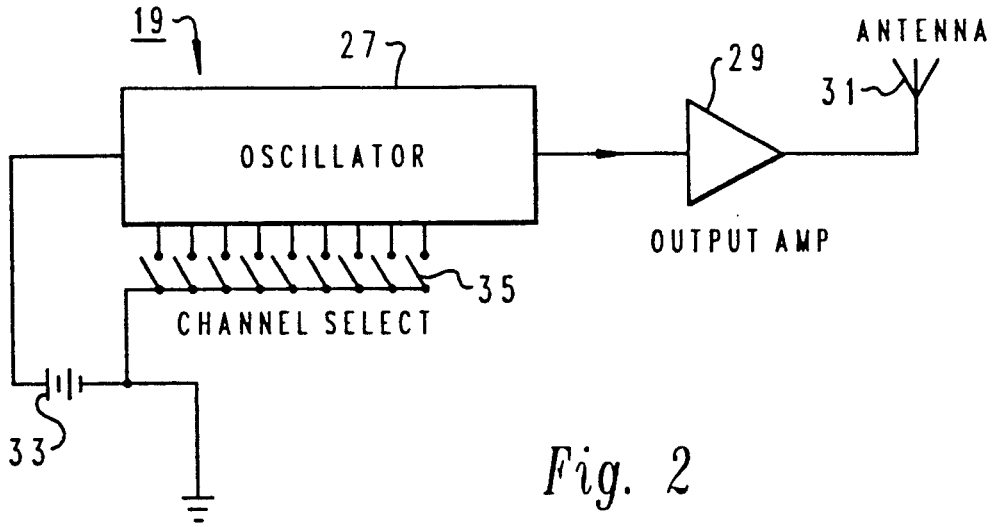
FIG. 2 is an electrical schematic diagram of the transmitter.

The transmitter 19 produces a continuous wave signal at a fixed narrow band frequency. Referring to FIG. 2, the transmitter 19 includes an oscillator 27, an amplifier 29, an antenna 31 and a battery 33. In the preferred embodiment, the oscillator 27 is a crystal oscillator. The crystal is contained in a package that is mechanically mounted to a printed circuit board in a shock absorbing manner. In addition, an elastomeric potting compound is used to pot around the crystal package to further dampen vibrations. The output of the oscillator 27 is connected to the input of the amplifier 29, which boosts the signal to a level suitable for transmitting. The output of the amplifier 29 is connected to the transmitting antenna 31. The transmitting circuit is powered by the battery 33.

The transmitting antenna 31 is of the loop type and is configured to provide either a magnetic field or an electromagnetic field. The transmitting antenna is made inductively reactive to produce a magnetic, or primarily magnetic, field. To produce an electromagnetic field, the transmitting antenna is made equally inductive and capacitive. As will be explained hereinafter, a magnetic field configuration provides for better spatial resolution than an electromagnetic field configuration.

The transmitter 19 is contained in a housing that is sealed and mounted onto a car. The location of the transmitter 19 usually depends on the type of car it is mounted to. The transmitting antenna 31 is located close to the track surface, so as to be close to the receiving antennas 17, 17A when the car passes over. This enhances the spatial resolution of the system. We have found that when the transmitting antenna is configured to produce a magnetic field, locating the transmitting antenna about 10 inches or less from the road surface works well. On Formula 1 cars the transmitting antenna is located within the transmitter housing, so that the transmitter is self-contained. The transmitter is located in the nose cone of the car. In this case, the transmitting antenna is 3 to 6 inches above the road surface. On stock cars, the transmitter is mounted higher. The transmitting antenna is connected to the transmitter by a coaxial cable.

Each car has a unique transmitter frequency. This enables each car to be distinguished from the other cars on the track. For the preferred embodiment, the frequencies used are in the 1 MHz–10 MHz range, with a separation between adjacent frequencies of about 8 KHz. have found that using frequencies between 4.5–4.9 MHz works well. This frequency range is optimized for noise and spatial resolution. If the frequency of a transmitter is too low, spatial resolution of the car will degrade because of the filter responses to longer wavelengths. On the other hand, if the transmitter frequency is too high, rf interference and noise become a problem.

The oscillator 27 in the transmitter 19 generates a continuous wave signal at a precise frequency. The precision of the transmitter frequency enables precision bandpass filtering to take place in the receiver system, which filtering eliminates noise. With a crystal oscillator in the transmitter, the frequency is selected by installing the appropriate crystal during manufacturing. If it is desired to provide adjustment of the transmitter frequency, a conventional phase-locked loop frequency synthesizer with a master crystal is used as the oscillator 27. The frequency is selected with binary switches 35. This enables the transmitter frequency to be changed from one race to another.

Figure 3:
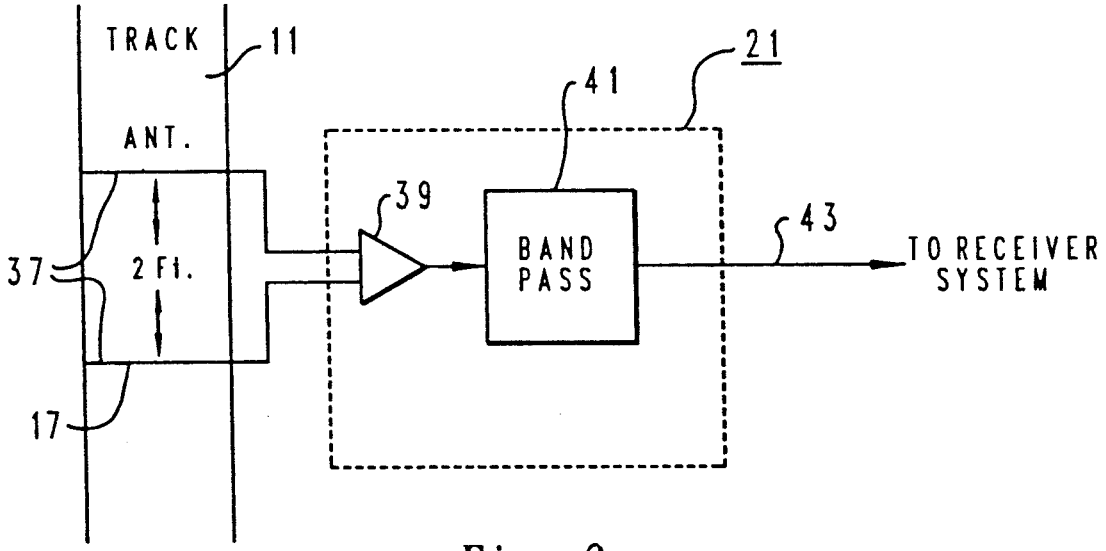
FIG. 3 is an electrical schematic diagram of the local amplifier and the receiving antenna.

In FIG. 3, a receiving antenna 17 and a local amplifier 21 are shown. The receiving antenna is made up of two wires 37 embedded in the track 11. The antenna wires are located about ¼ inch below the track surface and extend across the entire width of the track 11. To install the antenna wires, two parallel shallow grooves are made in the road surface. An antenna wire 37 is located in each groove. The grooves are filled with rubber traffic compound and are smoothed over. The antenna wires 37 are located about 2 feet apart from each other. The receiving antenna wires 37 are connected to the input of the respective local amplifier 21. There is provided a local amplifier 21 for each receiving antenna 17.

The local amplifier 21 is preferably located adjacent to the side of the track so as to be close to the receiving antenna. The local amplifier 21 is battery powered so as to be self-contained. The local amplifier has a differential amplifier 39 and a bandpass filter 41. The receiving antenna wires 37 are connected to the inputs of the differential amplifier 39. The differential amplifier eliminates common mode noise. Alternatively, a single ended input into the amplifier could be used, wherein one of the receiving antenna wires is connected to an input of the amplifier and the other of the antenna wires is connected to an amplifier ground. The output of the amplifier 39 is connected to the bandpass filter 41. The bandpass filter has a bandwidth of about 500 KHz to eliminate most automobile ignition noise and extraneous rf interference. The filter 41 passes all of the transmitter frequencies of interest. The output of the bandpass filter 41 is connected to the input of one of the receiver systems 23, by way of a coaxial cable 43. There is provided a receiver system 23 for each local amplifier 21.

Figure 4:
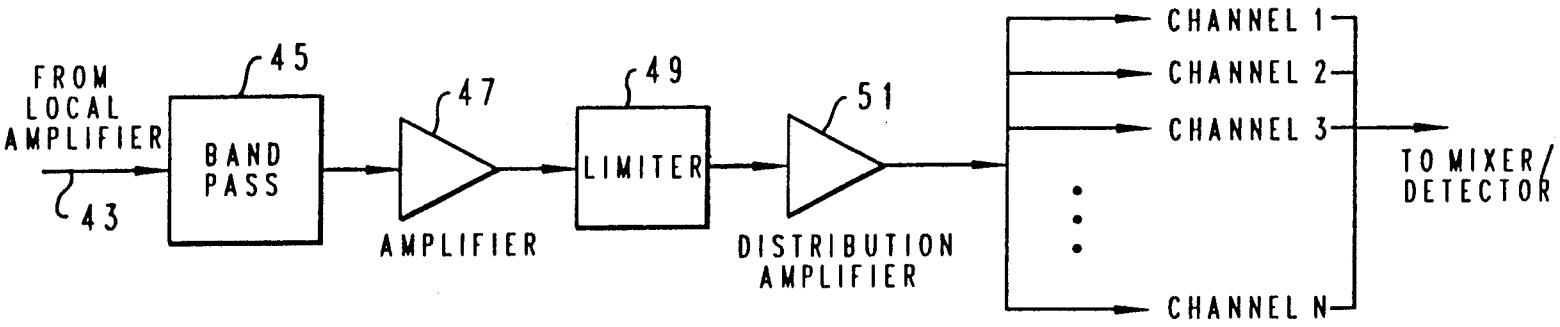
FIG. 4 is an electrical schematic diagram of the front end of the receiver system.

The receiver systems 23 are typically located some distance away from the local amplifiers, such as near the computer 25. Each receiver system 23 has a common circuit section (see FIG. 4) and a mixer and detector section for each channel (see FIG. 5). Referring to FIG. 4, the common circuit section has a bandpass filter 45, an amplifier 47, a limiter 49, and a distribution amplifier 51. The bandpass filter 45 receives the output of the respective local amplifier 21. The bandpass filter 45 is an eight pole Chebyshev filter so as to provide a narrow bandwidth. The filter 45 passes all of the transmitter frequencies of interest. The filter 45 is substantially the same as the filter 41. The filter 45 eliminates any induced interference in the coaxial cable 43. The output of the bandpass filter 45 is connected to the input of the amplifier 47, which boosts the signal from the local amplifier. The output of the amplifier 47 is connected to the limiter 49. The limiter limits the signal to a predetermined amplitude for ease of detection later in the receiver system. The limiter 49 is linear so as to produce a sine wave. The output of the limiter 49 is connected to the input of the distribution amplifier 51. The distribution amplifier 51 is a power amplifier that drives the signal through all of the channels through the various mixer and detector sections.

After the distribution amplifier 51, the circuit divides into plural channels, there being one channel for each transmitter frequency. Thus, for example, car 1, with a transmitter frequency of 4.500 MHz, would be assigned to channel 1. Car 2, with a transmitter frequency of 4.508 MHz, would be assigned to channel 2 and so on.

Figure 5:
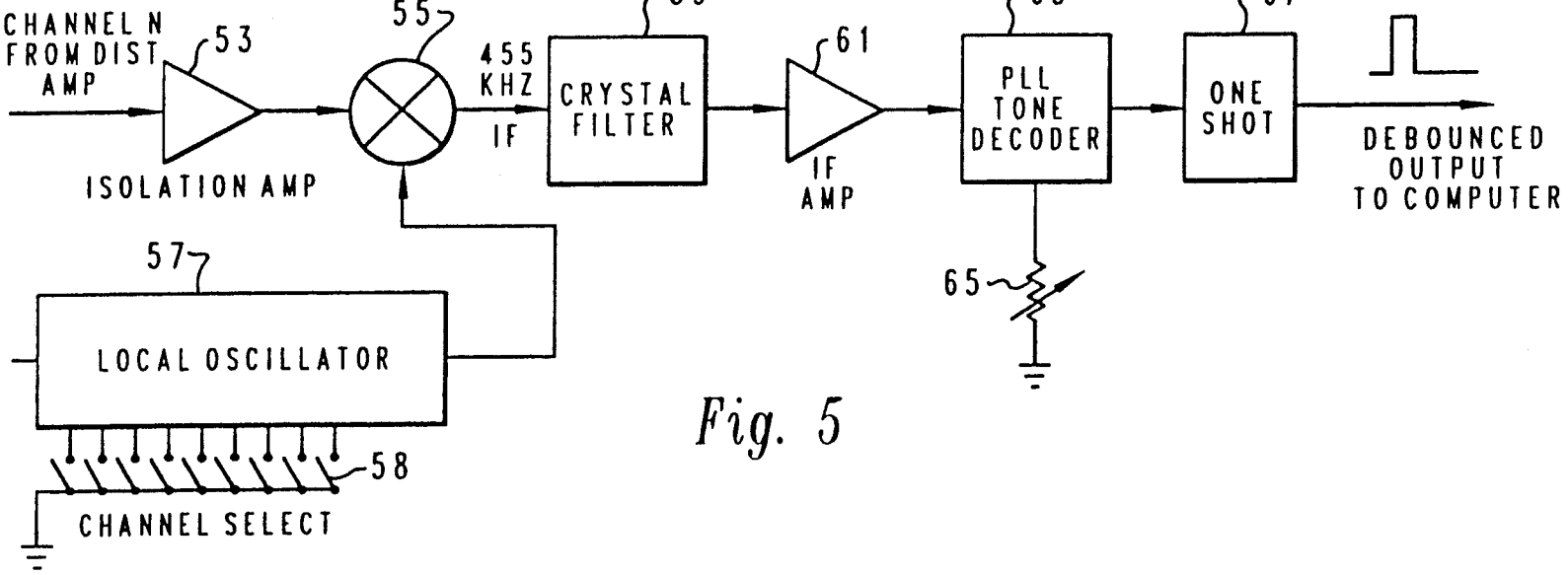
FIG. 5 is an electrical schematic diagram of a single channel in the back end of the receiver system.

Each channel has a mixer and detector section as shown in FIG. 5. The output of the distribution amplifier is connected to the input of plural isolation amplifiers 53, there being one isolation amplifier for each channel. The isolation amplifier 53 on each channel prevents crosstalk between the channels, which crosstalk may be produced by mixers on the other channels.

The output of the isolation amplifier 53 is connected to the input of a mixer 55. The other input of the mixer 55 is connected to a local oscillator 57. Like the transmitter oscillator 27, the local oscillator 57 may be a crystal oscillator or a frequency synthesizer with a master crystal which permits frequency selection by way of binary switches 58. The local oscillator 57 produces a continuous wave signal at a precise frequency. The frequency of the local oscillator 57 signal differs from the transmitter frequency of interest by an intermediate frequency. The output of the mixer is an intermediate frequency (if) signal that enters the crystal filter 59. The crystal filter 59 has a narrow bandwidth of 1.5–2 KHz. The precision of the transmitter frequency enables the use of the narrow bandwidth crystal filter 59. Thus, the filter 59 passes only the received signal from the transmitter frequency of interest and blocks all the other signals from the other transmitters. For example, the filter 59 on channel 1 would pass the signal from the car 1 transmitter, while blocking all of the other signals from the other cars.

In the preferred embodiment, the mixers on the channels produce an if signal of 455 KHz whenever a received signal from the transmitter assigned to the respective channel is processed. This enables the use of a commercially available, off the shelf, high precision crystal filter, which is available at a relatively inexpensive price. The filter 59 has a center frequency of 455 KHz. The output of the crystal filter 59 is connected to the intermediate frequency amplifier 61 for signal boosting.

The output of the intermediate frequency amplifier 61 is connected to the input of a phase-locked loop tone decoder 63. In the preferred embodiment, the conventional tone decoder 63 is tunable to trigger only on a 455 KHz signal. In addition, the tone decoder 63 is adjustable, by way of a variable resistor 65, to trigger on different lengths of signal, for example, 10 to 1000 cycles. This provides immunity from fast noise spikes. The tone decoder 63 is adjusted to detect signals produced by the fastest car speeds on the track. Slower speeds will produce longer signals. For example, for Formula 1 racing, the tone decoder is adjusted to detect signals of 1 to 2 millisecond duration. For stock car racing, 2 to 3 millisecond signals are detected. The output of the tone decoder 63 is a digital pulse that is high when the decoder locks onto the incoming signal.

The output of the tone decoder 63 is connected to the input of a one shot 67. The one shot 67 stretches out the pulse signal to a duration that is readily detectable by the computer 25. If the output of the tone decoder 63 is less than 10 milliseconds long, the one shot 67 produces a 10 millisecond pulse. If the output of the tone detector is greater than 10 milliseconds, then the one shot produces a pulse having an equal duration to the tone decoder output.

The output of the one shot 67 is connected to the computer system 25 (see FIG. 1). The outputs from all of the channels are connected to the computer system. The computer detects the occurrence and the time of occurrence of each pulse on each channel. Each channel is identified with a particular race car, enabling the computer to distinguish between individual race cars. When plural receiving antennas 17, 17A are used, the computer also identifies which receiving antenna produced the pulse. The computer processes the information to determine the lap number, elapsed time and the place of each car in the race. This information is then displayed on a monitor.

The operation of the timing and scoring system 13 of the present invention will now be described. The timing and scoring system 13 is able to distinguish each car from all of the other cars on the track. Each car is equipped with a transmitter 19 that generates a signal having a unique frequency. Thus, no two cars are equipped with transmitters having the same frequency. This allows the system 13 to identify the car that produced a received signal by examining the frequency of the signal.

In addition, the system 13 is able to simultaneously detect all of the cars if the need arises. For example, if two or more cars crossed the receiving antenna so as to produce two received signals simultaneously on the receiving antenna, the system could identify all of those cars. This is because the receiver system is equipped with one channel per race car or transmitter frequency.

Each channel stands ready to receive the signal from its designated transmitter.

The system 13 provides the requisite noise immunity necessary to isolate on the transmitter signals. Each transmitter 19 produces a continuous wave signal, having a frequency that is very accurate. The signals that are received by the receiving antenna 17 include the transmitted signals and noise produced by local radio and television stations, powerlines, two-way radios and the like. Also contributing to the noise problem is the ignition systems of the race cars. The ignition systems produce broad band noise due to the sharp rise times in the ignition pulses. The system passes the received signals through a common mode filter 39, wherein all common mode noise is rejected. Next, the received signals pass through bandpass filters 41, 45 that pass all of the frequencies used by the transmitters, while rejecting all other frequencies. Next, the system passes the received signals through precision crystal bandpass filters 59, having very narrow pass bands. There is provided a crystal filter for each channel or car transmitter. The crystal filters reject all frequencies except for the signals having frequencies that are very close to the particular transmitter frequency of interest. The crystal filters reject signals produced by those transmitters that are not of interest on the respective channel.

Crystal filters are very expensive, unless they are standard off the shelf parts. In order to enable the use of inexpensive standard crystal filters, the system translates the frequency of the received signals to an intermediate frequency. The intermediate frequency is chosen by selecting a standard crystal filter. In order to translate the received signal of interest to the appropriate bandwidth of the crystal filter, a mixer 55 is used. The mixer 55 has a local oscillator 57 that produces a signal having a frequency that is the transmitter frequency of interest plus some predetermined value. The mixer produces an intermediate frequency signal that is then filtered by the crystal filter. All of the mixers, when processing their respective received signals from their designated transmitters, produce if signals having the same frequency.

After the if signal of interest passes through the crystal filter 59, it enters a tone decoder 63. The tone decoder 63 detects those signals that are of a predetermined number of cycles. Signals, such as noise signals, having an insufficient duration are rejected. Thus, any noise signals that have the same frequency as the signal of interest will be rejected by the tone decoder.

The detected received signal goes from the receiver system 23 to the computer system 25. The computer system tracks each car, tabulating the number of laps driven and the elapsed time.

The system 13 also has good spatial resolution for each car. A car can be resolved within 0.5–2 feet of the finish line. The enhanced spatial resolution is due to the low transmitting range of the transmitter 19. In the preferred embodiment, the transmitter range is only 12 to 18 inches. The low transmitter range is a result of low transmitter power and the configuration of the transmitting antenna. The transmitter 19 produces a very weak signal, amounting to only a few microwatts. Besides enhancing spatial resolution, another advantage to having a low power transmitter is the lack of interference or noise produced by the transmitter, which might interfere with other electronic systems. In the preferred embodiment, the transmitting antenna 31 is configured to produce a magnetic field. This produces an induced e-field effect at the receiving antenna 17 to produce a received signal. The advantage to producing a magnetic field is that the transmitter field pattern is reduced, thereby enhancing spatial resolution. In practical terms the transmitter has a reduced effective range.

Figure 6:
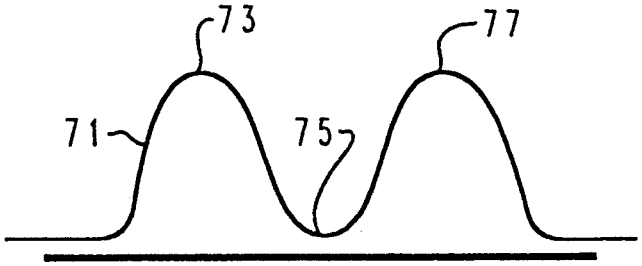
FIG. 6 is an electrical schematic diagram of a received signal as received by the receiving antenna.

The operational specifics of the system will now be described. The transmitter 19 on each race car 15 produces a continuous wave signal with a unique frequency. As a car passes over the receiving antenna 17, the transmitter signal is received by the receiving antenna as a received signal 71, as shown in FIG. 6. As the transmitting antenna 31 approaches a first one of the receiving antenna wires 37, the received signal 71 will increase. When the transmitting antenna is directly over the first receiving antenna wire, the received signal reaches a peak 73. As the transmitting antenna moves away from the first antenna wire and moves toward the second antenna wire, the received signal falls off to a minimum 75. The minimum occurs when the transmitting antenna is midway between the antenna wires. As the transmitting antenna moves closer to the second antenna wire, the signal approaches a second peak 77, which tapers off as the transmitting antenna moves away from the receiving antenna.

The received signal 71 has a frequency component which is the same as the transmitter frequency. The duration of the received signal depends on the speed of the passing car. The faster the car, the shorter the duration.

The received signal 71 enters the local amplifier 21 where it is amplified and filtered. The bandpass filter 41 eliminates much of the auto ignition noise and extraneous rf interference that is outside of the transmitter frequency range. The received signal then travels to the respective receiver system 23, where it is filtered again. The second bandpass filter 45 eliminates any induced interference in the coaxial cable 43. The received signal 71 is amplified by the amplifier 47. The signal is then limited to a predetermined amplitude by the limiter 49. With this arrangement, the received signal 71 is detected early on at about 10–20% of the peak amplitude 73. The distribution amplifier 51 boosts the power of the signal so as to drive it into all of the channels.

In each channel, the signal passes through the isolation amplifier 53 and into the mixer 55. There, it is beat down into an intermediate frequency to form an if signal. In the preferred embodiment, the frequency of the if signal is 455 KHz. The if signal enters the narrow band crystal filter 59. If the if signal is not 455 KHz, it is unable to pass through the crystal filter. The if signal is only able to appear on the channel that is tuned to receive it. Tuning is accomplished by selecting the frequency of the local oscillator 57.

Once the signal passes through the crystal filter 59, it is amplified and enters the tone decoder 63. The tone decoder looks for a signal at the exact frequency (455 KHz) and of a specified minimum duration (for example 1 millisecond). The received signal is detected by the tone decoder, which then produces a pulse lasting the duration of the signal. The pulse from the tone decoder is stretched out by the one shot 67. The output of the one shot goes to the computer 25, which records the occurrence of the signal, indicating that the car assigned to that channel has passed over the receiving antennas. The computer also records the time of occurrence using a built in clock.

As shown in FIG. 1, plural receiving antennas 17, 17A can be provided along the track. Each receiving antenna is assigned unique channels so that the identification of the receiving antenna can be obtained. Thus, the passage of car 1 over the first receiving antenna 17 can be distinguished from the passage of car 1 over a second receiving antenna 17A.

In addition each car 15 can be provided with two or more transmitters 19, 19A. The use of two transmitters provides redundancy of equipment thereby enhancing the reliability of the system 13. The two transmitters can have the same frequency or they could have different frequencies. If the transmitters have different frequencies, then both frequencies are unique with respect to the transmitters on the other cars. If the transmitters 19, 19A are designed to have the same frequency, in actuality the transmitter frequencies will differ, if only by a few hertz, because of manufacturing tolerance in the transmitter crystals. The two transmitters 19, 19A will not interfere with each other. The system 13 will detect the earliest transmitter signal and ignore the later transmitter signal.

The foregoing disclosure and the showings made in the drawings are merely illustrative of the principles of this invention and are not to be interpreted in a limiting sense.

We claim:

1. A system for automatically tracking plural vehicles traversing a track, comprising:

a) a transmitter means located on each vehicle, each transmitter means transmitting a continuous wave signal that has a frequency that is unique with respect to the signals transmitted by the other transmitter means;

b) a receiving antenna that is located on said track such that said vehicles and said plural transmitter means can pass adjacent thereto, said receiving antenna producing a received signal for each transmitter means signal received by said receiving antenna;

c) receiver means coupled to said receiving antenna, said receiver means comprising narrow bandpass filter means, there being a narrow bandpass filter means on each one of a plural number of channels in said receiver means, each channel being for detecting a received signal from one of said transmitter means, said narrow bandpass filter means on each channel being for filtering out all frequencies lying outside of the frequency of said respective received signal;

d) each channel having a mixer means therein, each of said mixer means for producing an intermediate frequency signal from said respective received signal, each of said mixer means having a first input that is connected with a respective local oscillator and a second input that is connected with said receiving antenna, each of said local oscillators producing signals such that said intermediate frequency signals on all of said channels have the same frequency, said output of said mixer means being connected with said respective narrow bandpass filter means;

e) each channel having a signal length detection means connected to an output of said respective narrow bandpass filter means, each of said signal length detection means for detecting a respective intermediate frequency signal of a predetermined duration and producing an output signal whenever said intermediate frequency signal having said predetermined duration is detected; wherein said output signal indicates that said vehicle having the transmitter means with the frequency that has been assigned to said channel has passed adjacent to said receiving antenna.

2. The system of claim 1 wherein each of said transmitter means operates in the 1–10 MHz range.

3. The system of claim 1 wherein said receiver means comprises a common mode differential amplifier connected with said receiving antenna, said bandpass filter means being connected with an output of said differential amplifier.

4. The system of claim 1 further comprising computer means for tabulating said output signals from each of said channels, said computer means being connected with outputs of said plural signal length dection means, said computer means also for tracking the elapsed time between output signals on each channel.

5. The system of claim 1 wherein each of said narrow bandpass filter means comprises a crystal filter having a bandpass of 1.5–2 KHz.

6. The system of claim 1 wherein each of said transmitter means comprises a transmitting antenna that is configured to produce primarily a magnetic field.

7. The system of claim 1 wherein each transmitter means transmits said respective continuous wave signal with microwatt power, wherein the range of each of said transmitter means is only a few feet.

8. The system of claim 1, further comprising:

a) computer means for tabulating said output signals from each of said channels, said computer means being connected with outputs of said plural signal length detection means, said computer means also for tracking the elapsed time between output signals on each channel;

b) each of said narrow bandpass filter means comprises a crystal filter having a bandpass of 1.5–2 KHz;

c) each of said transmitter means comprises a transmitting antenna that is configured to produce primarily a magnetic field;

d) each transmitter means transmits said respective continuous wave signal with microwatt power, wherein the range of each of said transmitter means is only a few feet;

e) each of said transmitter means operates in the 1–10 MHz range;

f) said receiver means comprises a common mode differential amplifier connected with said receiving antenna, said bandpass filter means being connected with an output of said differential amplifier.

9. The system of claim 1 wherein each vehicle is provided with two transmitter means for redundancy, each transmitter means transmitting a signal that has a frequency that is unique with respect to signals transmitted by transmitter means on other vehicles.

10. A system for automatically timing and scoring plural vehicles traversing a track, comprising:

a) plural transmitter means for transmitting signals, there being a transmitter means on each vehicle, each transmitter means transmitting a signal having a frequency that is unique with respect to the signals transmitted by the other transmitter means, each transmitter means operating in the 1–10 MHz range;

b) receiver means for receiving said transmitted signals so as to form received signals, said receiver means comprising a receiving antenna that is located on said track such that said vehicles pass adjacent thereto;

c) said receiver means comprising first amplifier means and first filter means both being connected with said receiving antenna, said first filter means comprising a bandpass filter for filtering out all frequencies lying outside of said plural transmitter means frequencies of interest;

d) limiter means for limiting the amplitude of said received signals to a predetermined amplitude, said limiter means being connected with said first filter means;

e) said receiver means comprising plural channels, there being one channel for each transmitter frequency, all of said channels being connected with an output of said limiter means;

f) each channel comprising mixer means for mixing said received signals with a signal produced by a local oscillator, said mixer means producing an intermediate frequency signal at its output, each of said mixer means having a first input connected with said limiter means output and a second input connected with said local oscillator, said local oscillator signal having a frequency selected such that the frequency of said intermediate frequency signal differs from the frequency of the received signal of interest by a predetermined amount, said intermediate frequency signals from said channels, when produced by the respective received signals of interest, all having the same frequency;

g) each channel having second filter means coupled with said output of said mixer means, said second filter means comprising a narrow band bandpass filter;

h) each channel having signal length detection means for detecting a signal of a predetermined duration, said signal length detection means being coupled with an output of said second filter means, said signal length detection means producing a signal at its output that is representative of said respective vehicle for said respective channel being in near proximity to said receiving antenna.

11. The system of claim 10 wherein said signal length detection means is of the phase-locked loop type.

12. The system of claim 10 wherein each vehicle is provided with two transmitter means for redundancy, each transmitter means transmitting a signal that has a frequency that is unique with respect to signals transmitted by transmitter means on other vehicles.

13. A method for tracking plural vehicles traversing a track, comprising the steps of:

a) providing a transmitter means on each vehicle, and a receiving antenna on said track;

b) transmitting a signal with each transmitter means, each transmitted signal having a unique frequency with respect to said other transmitted signals;

c) driving said vehicles around said track so as to pass adjacent to said receiving antenna, wherein a received signal is produced in said receiving antenna by each of said transmitter means passing adjacent to said receiving antenna;

d) filtering each of said received signals so as to remove those frequencies that are different from said respective received signal e) filtering each of said received signal so as to remove noise signals having the same frequency as said respective received signal by rejecting those signals having a temporal duration that is less than a predetermined minimum temporal duration and passing those signals having a temporal duration that is more than said predetermine duration;

f) recording the occurrence of said respective passed signals so as to track the lap number of said respective vehicles and recording the time of occurrence of said respective passed signals so as to track the elapsed time of said respective vehicles.

* * * * *